US010504633B2

(12) United States Patent
Schu

(10) Patent No.: US 10,504,633 B2
(45) Date of Patent: Dec. 10, 2019

(54) DIAPHRAGM FOR AN X-RAY TUBE AND X-RAY TUBE WITH SUCH A DIAPHRAGM

(71) Applicant: YXLON International GmbH, Hamburg (DE)

(72) Inventor: André Schu, Schwarzenbek (DE)

(73) Assignee: YXLON International GmbH, Hamburg (DE)

( * ) Notice: Subject to any disclaimer, the term of this patent is extended or adjusted under 35 U.S.C. 154(b) by 83 days.

(21) Appl. No.: 15/815,987

(22) Filed: Nov. 17, 2017

(65) Prior Publication Data

US 2018/0342330 A1 Nov. 29, 2018

(30) Foreign Application Priority Data

Nov. 18, 2016 (DE) ..... 10 2016 013 747

(51) Int. Cl.

| | |
|---|---|
| ***G21K 1/02*** | (2006.01) |
| ***H05G 1/02*** | (2006.01) |
| ***H05G 1/50*** | (2006.01) |
| ***H01J 35/14*** | (2006.01) |

(52) U.S. Cl.
CPC ..... *G21K 1/02* (2013.01); *H01J 35/14* (2013.01); *H05G 1/02* (2013.01); *H05G 1/50* (2013.01)

(58) Field of Classification Search
None
See application file for complete search history.

(56) References Cited

U.S. PATENT DOCUMENTS

| | | | | |
|---|---|---|---|---|
| 3,227,880 | A | 1/1966 | Wideroe | |
| 2008/0112540 | A1* | 5/2008 | Rogers | G21F 1/08 378/203 |
| 2013/0156161 | A1* | 6/2013 | Andrews | H01J 35/16 378/140 |
| 2013/0235975 | A1* | 9/2013 | Tamura | H01J 35/12 378/62 |
| 2014/0153695 | A1* | 6/2014 | Yanagisawa | G01N 23/04 378/62 |

FOREIGN PATENT DOCUMENTS

DE 102006062454 A1 7/2008

* cited by examiner

*Primary Examiner* — Hoon K Song
(74) *Attorney, Agent, or Firm* — Abelman, Frayne & Schwab

(57) ABSTRACT

A diaphragm for restricting a cross section of an electron beam of an X-ray tube includes a base body made of a first material, which has a first cylindrical or conical diaphragm aperture, and an additional body made of a second material, which has a second cylindrical or conical diaphragm aperture. The additional body in the installed state is arranged on the side near the electron source, wherein the atomic number of the first material is greater than the atomic number of the second material. The diameters of the diaphragm apertures at the end far from the electron source are not smaller than at the end near the electron source, and the second diaphragm aperture at its end far from the electron source lies completely inside the first diaphragm aperture at its end near the electron source.

14 Claims, 7 Drawing Sheets

DIAPHRAGM FOR AN X-RAY TUBE AND X-RAY TUBE WITH SUCH A DIAPHRAGM

CROSS-REFERENCE TO RELATED APPLICATION

This application claims benefit under 35 U.S.C. § 119 to German application no. DE 10 2016013747.9, filed Nov. 18, 2016, the contents of which are incorporated by reference in its entirety.

FIELD OF THE INVENTION

The invention relates to a diaphragm for restricting the cross section of an electron beam of an X-ray tube as well as to an X-ray tube, in particular a microfocus X-ray tube.

BACKGROUND OF THE INVENTION

The image quality in the case of X-ray tubes, in particular in the case of microfocus X-ray tubes, is impaired by the fact that an interfering bright circular disc often appears in the generated X-ray image. This circular disc is caused by scattered X-radiation which forms when electrons strike the diaphragm body of a lens diaphragm of the X-ray tube. The lens diaphragm is referred to as diaphragm in the context of this application. As the diaphragm body must be high-temperature-resistant and therefore consists in particular of metal, when the electrons strike the diaphragm body short-wave X-radiation forms which penetrates the target and projects an image of the diaphragm pinhole onto the image receptor when higher energies of the electrons are used.

DE 10 2006 062 454 A1 describes a microfocus X-ray tube which solves this problem by means of a coating of the diaphragm. The metal of the diaphragm is coated with a material with a low atomic number in order to reduce the stray radiation. A disadvantage here is that coatings are usually only possible in the micrometre range. For example, a carbon coating of approximately 4 μm is possible. The penetration depth of the electrons is, however, much more than 4 μm in the case of high energies, as a result of which the electrons penetrate all the way into the metal and generate stray radiation. Moreover, the diaphragm is exposed to high thermal loads. In the case of coated diaphragms this often leads to a peeling of the coating.

A collimator for electron beams in an X-ray tube is known from U.S. Pat. No. 3,227,880. This collimator is constructed in two parts. Its part near the electron source—first part—consists of a metal with a low atomic number, for example aluminium, and its part far from the electron source second part consists of a metal with a high atomic number, for example lead. In principle, the collimator aperture passing through the two parts is formed such that its area is greater at the entrance side near the electron source than at its exit side far from the electron source; it thus narrows in the beam direction of the electron beam. The collimator aperture has a first aperture part (which is formed in the first part) and a second aperture part (which is formed in the second part). Both aperture parts in each case separately have a truncated cone-shaped surface area. These aperture parts can be formed either widening or narrowing in the beam direction. The first aperture at the end of the first aperture part far from the electron source is formed smaller than the second aperture at the end of the second aperture part near the electron source, with the result that there is a step in the beam direction, which extends into the electron beam. Alternatively, in the case of aperture parts in each case narrowing in the beam direction, the first and second apertures can also be the same size. In both embodiments, electrons can strike the second part and generate stray radiation there.

A diaphragm for an applicator to be used in electron irradiation therapy is known from DE 10 2011 005 450 A1. This diaphragm is constructed in a three-layer arrangement, wherein the layer facing the irradiation direction of the electrons consists of a first metal with a first atomic number, which is smaller than a second atomic number of a second material of the middle layer, which is in turn smaller than a third atomic number of a third material, a layer facing away from the irradiation direction of the electrons. The diaphragm aperture is formed in the shape of a cylinder jacket.

SUMMARY OF THE INVENTION

The object of the invention is to provide a diaphragm and an X-ray tube with such a diaphragm, which prevent the formation of bright circular discs in the X-ray image.

The object is achieved by a diaphragm according to the features of claim 1. As the diaphragm is divided into two component parts, the base body and the additional body, these two parts can consist solidly of different materials. According to the invention, the additional body consists of a second material with a lower atomic number (and density) than the first material of the base body. The electrons of the electron beam, which is restricted in terms of its diameter by the second diaphragm aperture, strike the additional body which is arranged on the side of the diaphragm near the electron source. As the second material has a lower atomic number than the first material, the proportion of short-wave X-rays which forms when the electrons of the electron beam strike the additional body and which leads to the interference in the form of the bright circular disc is reduced. A smaller portion of stray radiation can thus penetrate the target and cause image errors. As the first material of which the base body consists has a higher atomic number (and density) than the second material of which the additional body consists, the diaphragm fulfils the function of shielding against the stray radiation which forms in the interior of the X-ray tube. Due to the fact that the diameters of the diaphragm apertures at the end far from the electron source are not smaller than at the end near the electron source, they do not narrow in the axial direction, which on sides of the base body could have the result that electrons strike the first material during their flight through the first diaphragm aperture and the above-named interference is thereby generated—albeit to a small extent—in spite of the shielding by the additional body. The embodiment in which the diaphragm aperture of the additional body at its end far from the electron source lies completely inside the diaphragm aperture of the base body at its end near the electron source also prevents the electrons from being able to strike the first material during their flight through the first diaphragm aperture and the occurrence of interferences in the process.

An advantageous development of the invention provides that the diaphragm apertures of the additional body and of the base body are arranged concentrically relative to each other. In a particularly simple manner, this creates the possibility of designing the diameters of the two apertures to be small—both absolutely and relative to each other.

A further advantageous development of the invention provides that the diaphragm apertures of the additional body and of the base body are in each case conical and the diameter of the diaphragm aperture of the base body at its end near the electron source is greater than the diameter of the diaphragm aperture of the additional body at its end far from the electron source. The conical shape, in particular of the first diaphragm aperture, ensures that the electrons flying through the diaphragm do not strike the first material even if their trajectory is inclined slightly towards the centre axis of the first diaphragm aperture (for example because of the finite aperture angle of the electron beam), but pass through the first diaphragm aperture unscathed.

A further advantageous development of the invention provides that the additional body, on its surface far from the electron source, and the base body, on its surface near the electron source, are in contact with each other, in particular over their entire surface. In particular in the case of contact over the entire surface, the total height (in the direction of the electron beam) can thereby be kept low.

A further advantageous development of the invention provides that the first material is a metal. The first material of which the base body consists can be chosen within broad ranges according to the respective requirements, in particular with regard to a high temperature resistance. Metals such as molybdenum, tungsten or titanium are particularly suitable. A further advantageous development of the invention provides that the second material is aluminium, beryllium, silicon, carbon, in particular in the form of graphite, boron or a chemical compound of one or more of these elements. The second material of which the additional body consists can also be chosen within broad ranges according to the respective requirements. According to the function of the additional body consisting of the second material, the material has a low atomic number. The materials listed for the base body and the additional body are materials which have atomic numbers clearly different from each other for the first material on the one hand and for the second material on the other hand.

The difference between the atomic numbers of first material and second material is preferably at least 16, particularly preferably at least 36. For this reason, carbon (with the atomic number 6) is readily used for the second material and molybdenum (with the atomic number 42) is readily used for the first material. The materials according to the invention must be heat-resistant and have a high thermal conductivity, as they are intensely heated as a result of the electron bombardment or the exposure to the scattered X-radiation generated in the target. The materials also must not permit magnetization, as this would interfere with the fields inside the X-ray tube.

A further advantageous development of the invention provides that the base body, on its surface near the electron source, has a recess which corresponds to the outer contour of the surface of the additional body far from the electron source and is slightly larger than this. The additional body can thereby be joined to the base body in a very simple manner such that no change in the position of these two parts relative to each other can take place in the radial direction relative to the electron beam. Electrons are thus prevented from colliding with the first material and causing the undesired interference when they pass through the first diaphragm aperture as a result of a shift in the radial direction relative to the longitudinal axis of the second diaphragm aperture.

A further advantageous development of the invention provides that the additional body, on its surface near the electron source, has the shape of a concave spherical surface segment. The surface area of the additional body, in the region of the electron beam which strikes the additional body and is restricted by the second diaphragm aperture, is thereby enlarged, with the result that the heat generated around the second diaphragm aperture when the electrons strike is distributed better.

The object is also achieved by an X-ray tube with the features of claim 9. For this, the advantages specified above in relation to the diaphragm according to the invention also result.

A further advantageous development of the invention provides that there is a diaphragm holder which surrounds both the additional body and the base body of the diaphragm at their radial ends such that additional body and base body are pressed against each other. This prevents the relative position of the two parts of the diaphragm, base body and additional body, from changing, both in the axial direction and in the radial direction relative to the electron beam, which could lead to the electrons striking the first material of the base body and which would lead to an interference.

BRIEF DESCRIPTION OF THE DRAWINGS

Further advantages and details of the invention are explained in more detail in the following with reference to the embodiment example represented in the figures. There are shown in.

DETAILED DESCRIPTION OF THE INVENTION

Figure 1:
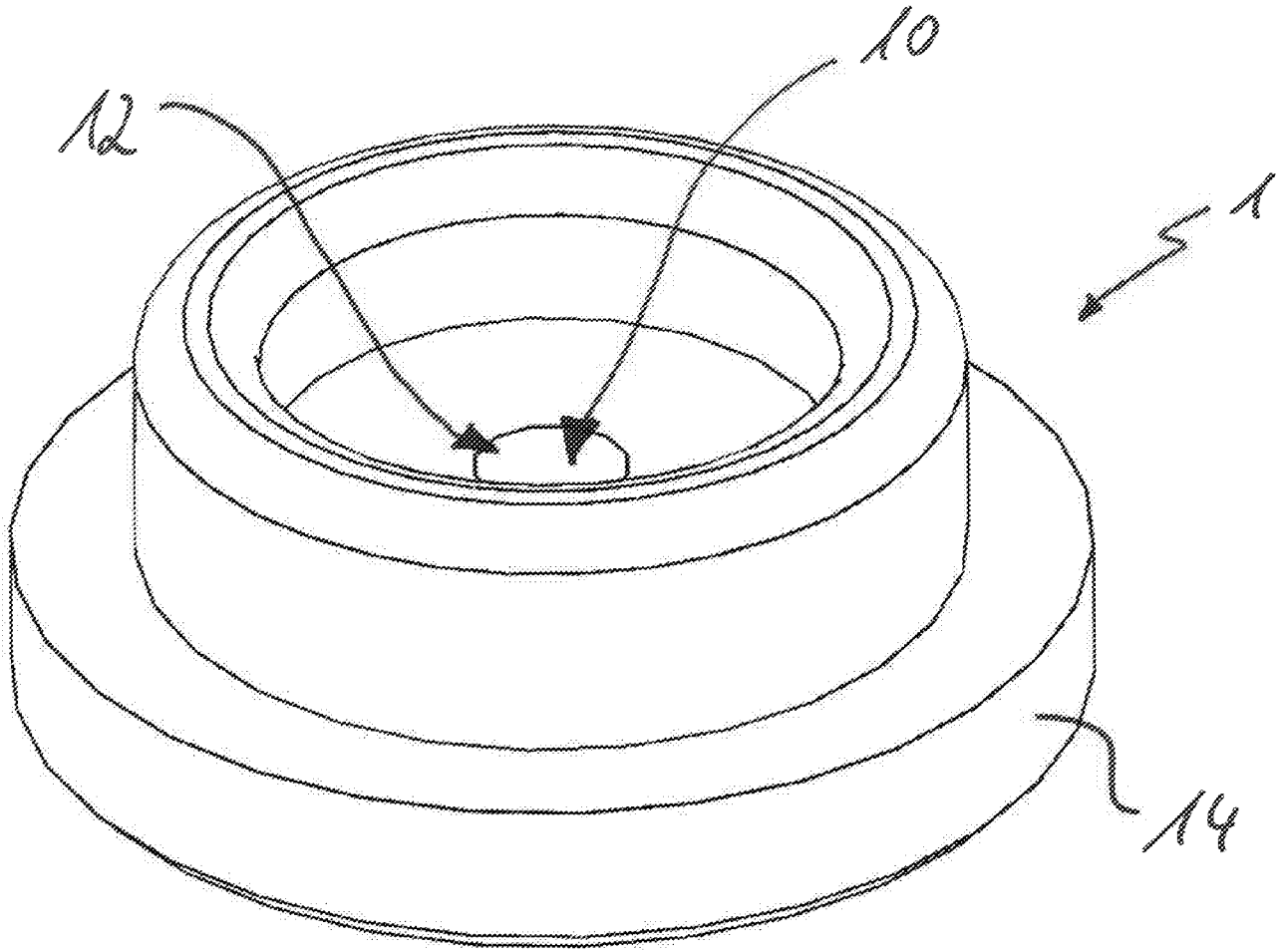
FIG. 1 a perspective view of a base body according to the invention.
Figure 2:
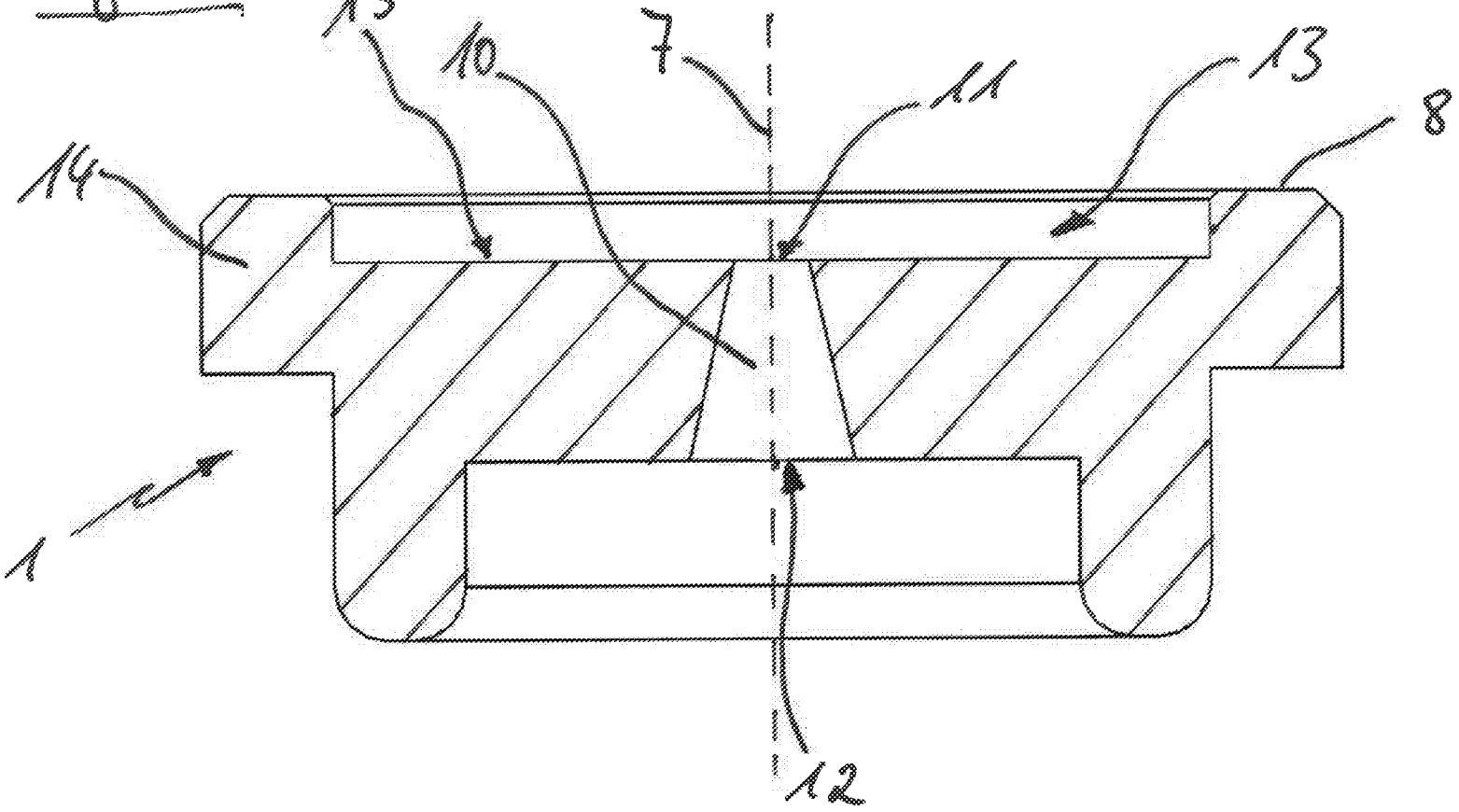
FIG. 2 a longitudinal section through the base body of FIG. 1.

A base body 1 according to the invention of a diaphragm for an X-ray tube is represented in FIGS. 1 and 2, wherein the perspective view of FIG. 1 shows the base body 1 from a direction at an angle from below in relation to the cross section of FIG. 2.

The base body 1 is formed axisymmetric about its longitudinal centre axis 7. It is part of a diaphragm for restricting an electron beam 5 (see FIG. 7) which, in the X-ray tube, serves to generate X-radiation at a target 9 (see FIG. 7).

The base body 1 is made of a first material, which must be heat-resistant to a high degree due to its position in the X-ray tube and must have a high thermal conductivity in order to remove the heat being generated in it. Moreover, as far as possible, it must not exert a magnetic influence, in order not to interfere with the electric fields in the X-ray tube. It is preferably made of a metal, as are the diaphragms known in the state of the art, in particular of molybdenum, tungsten or titanium.

Along its longitudinal centre axis 7, there is a first diaphragm aperture 10 which widens conically from a first diaphragm entrance aperture 11, which is located on the side near the electron source in the installed state, to a first diaphragm exit aperture 12, which is located on the side far from the electron source in the installed state.

On the side near the electron source the base body 1 has a circumferential flange 14 with a recess formed concentrically about the longitudinal centre axis, which recess forms a flat first locating surface 15.

On its side far from the electron source the base body 1 has a short hollow cylindrical extension which is at a large radial distance from the first diaphragm exit aperture 12.

Figure 3:
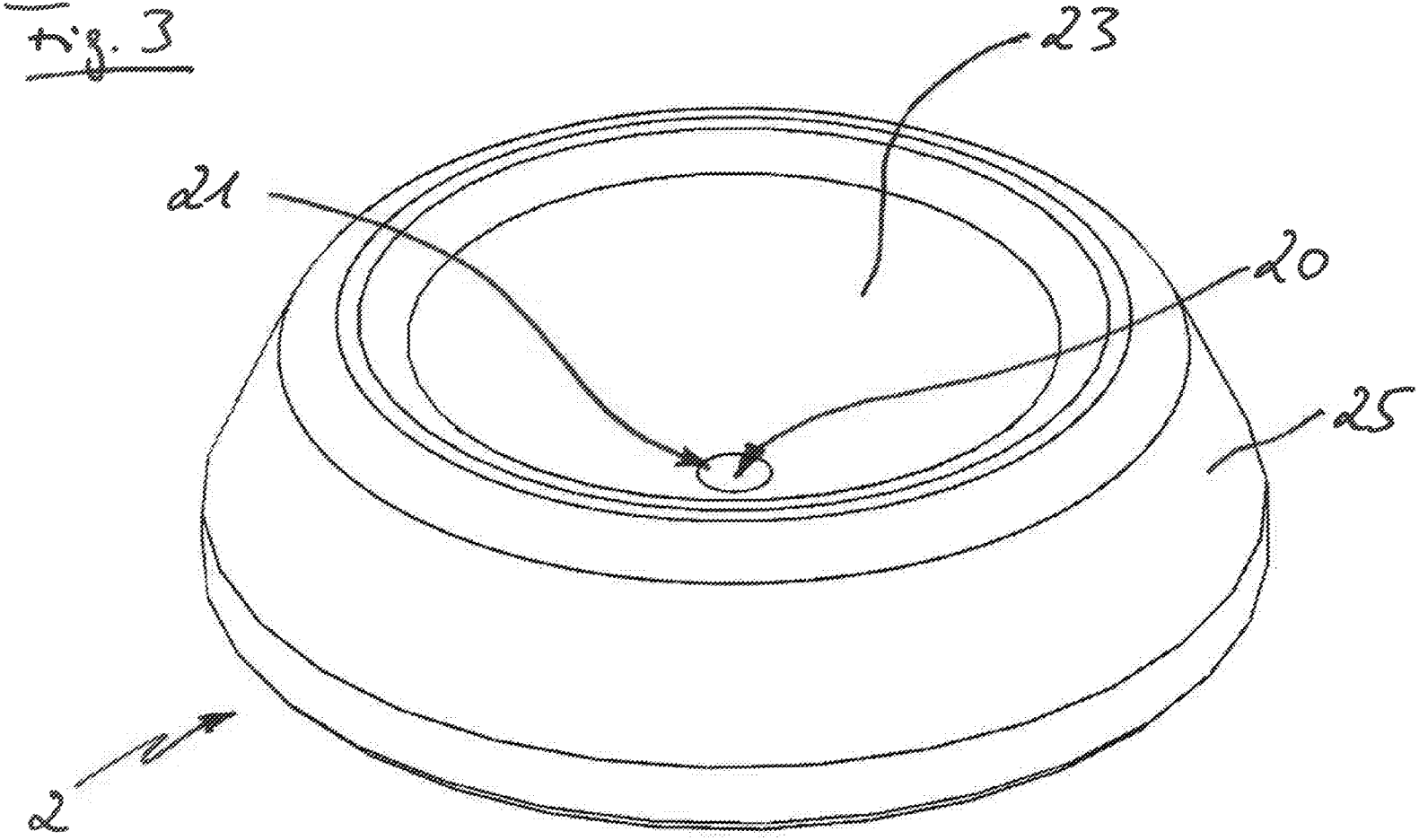
FIG. 3 a perspective view of an additional body according to the invention.
Figure 4:
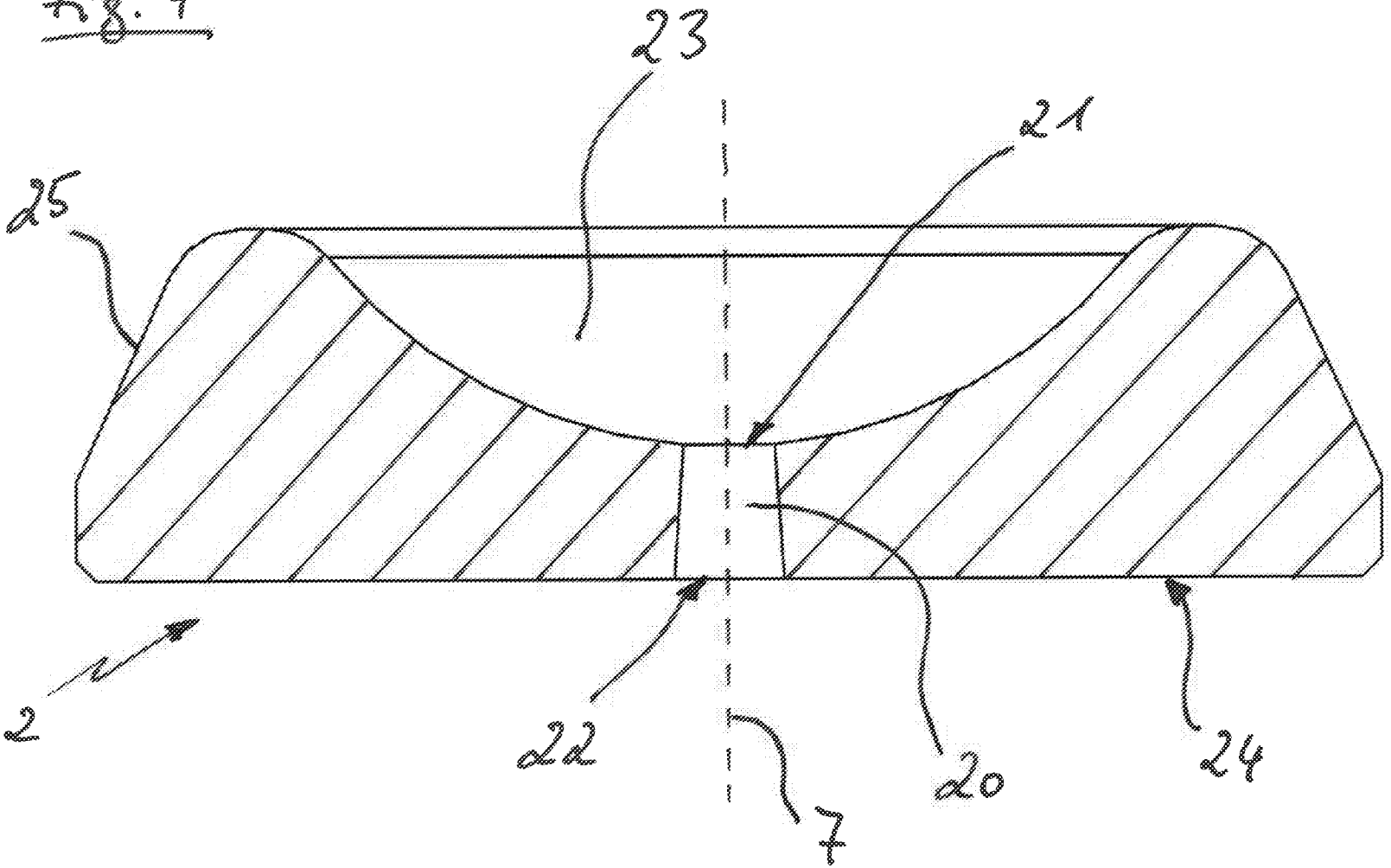
FIG. 4 a longitudinal section through the additional body of FIG. 3.

An additional body 2 according to the invention of the diaphragm is represented in FIGS. 3 and 4, wherein the perspective view of FIG. 3 shows the additional body 2 from a direction at an angle from above in relation to the cross section of FIG. 4, It is represented enlarged in relation to the base body 1 of FIGS. 1 and 2.

The additional body 2 is formed axisymmetric about its longitudinal centre axis 7. It is part of the diaphragm for restricting the electron beam 5 (see FIG. 7).

The additional body 2 is also made of a second material, which must be heat-resistant to a high degree due to its position in the X-ray tube and must have a high thermal conductivity in order to remove the heat being generated in it. Moreover, as far as possible, it must not exert a magnetic influence, in order not to interfere with the electric fields in the X-ray tube. It is preferably made of graphite, a carbon compound, beryllium or aluminium.

Along its longitudinal centre axis 7, there is a second diaphragm aperture 20 which widens conically from a second diaphragm entrance aperture 21, which is located on the side near the electron source in the installed state, to a second diaphragm exit aperture 22, which is located on the side far from the electron source in the installed state.

The radial outer surface is formed cylindrical in its lower part and as a conical jacket 25 in the upper part.

On the side near the electron source the additional body 2 has the shape of a concave spherical surface segment. On the side far from the electron source, in contrast, it has a flat second bearing surface 24.

Figure 5:
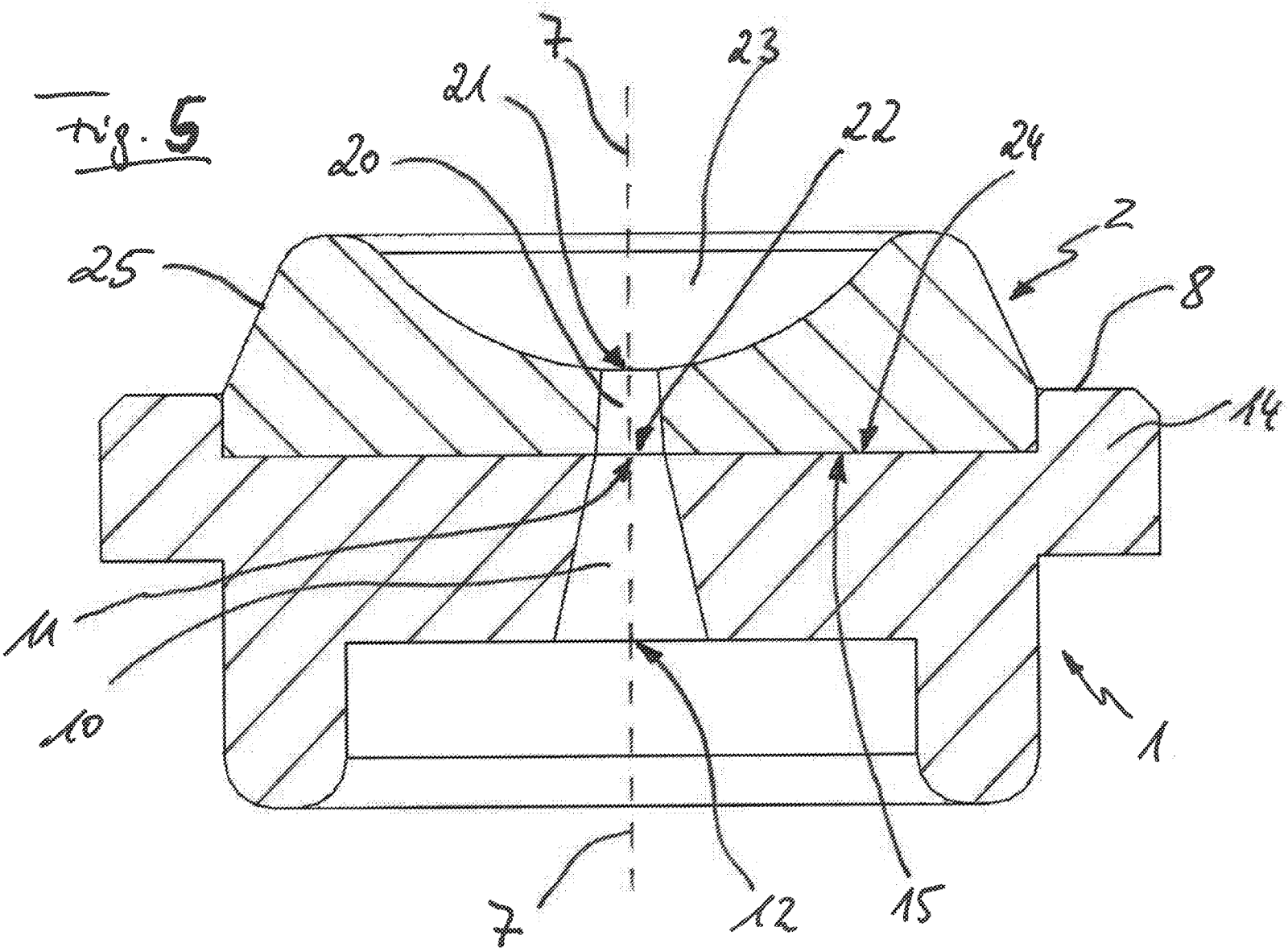
FIG. 5 a longitudinal section through a diaphragm with base body and additional body according to FIG. 6, FIG. 6 a perspective view of a diaphragm according to the invention with the base body of FIGS. 1 and 2 and the additional body of FIGS. 3 and 4 and FIG. 7 a schematic sectional drawing of a diaphragm according to the invention in a part of an X-ray tube.

A cross section—comparable to the cross sections of FIGS. 2 and 4—through the entire diaphragm is represented in FIG. 5. The two individual parts base body 1 and additional body 2 are represented in the correct size ratio relative to each other; compared with FIGS. 1 to 4, however, the scale is changed.

Base body 1 and additional body 2 are joined to each other such that their flat locating surfaces 15, 24 abut against each other and the lower end of the additional body 2 lies in the recess 13 of the base body 1. A radial invariability of the two parts with respect to each other is thus ensured. The alignment of the two parts is such that their respective longitudinal centre axes 7 coincide and form a common longitudinal centre axis 7, about which the entire obtained structure is axisymmetric.

The aperture angle of the cone of the second diaphragm aperture 20 is much smaller than the aperture angle of the cone of the first diaphragm aperture 10. In the represented embodiment example, the limiting case is represented, where second diaphragm exit aperture 22 and first diaphragm entrance aperture 11 have the same diameter. Within the framework of the invention, it is also possible for the diameter of the second diaphragm exit aperture 22 to be smaller than the diameter of the first diaphragm entrance aperture 11 (see FIG. 7).

Figure 6:
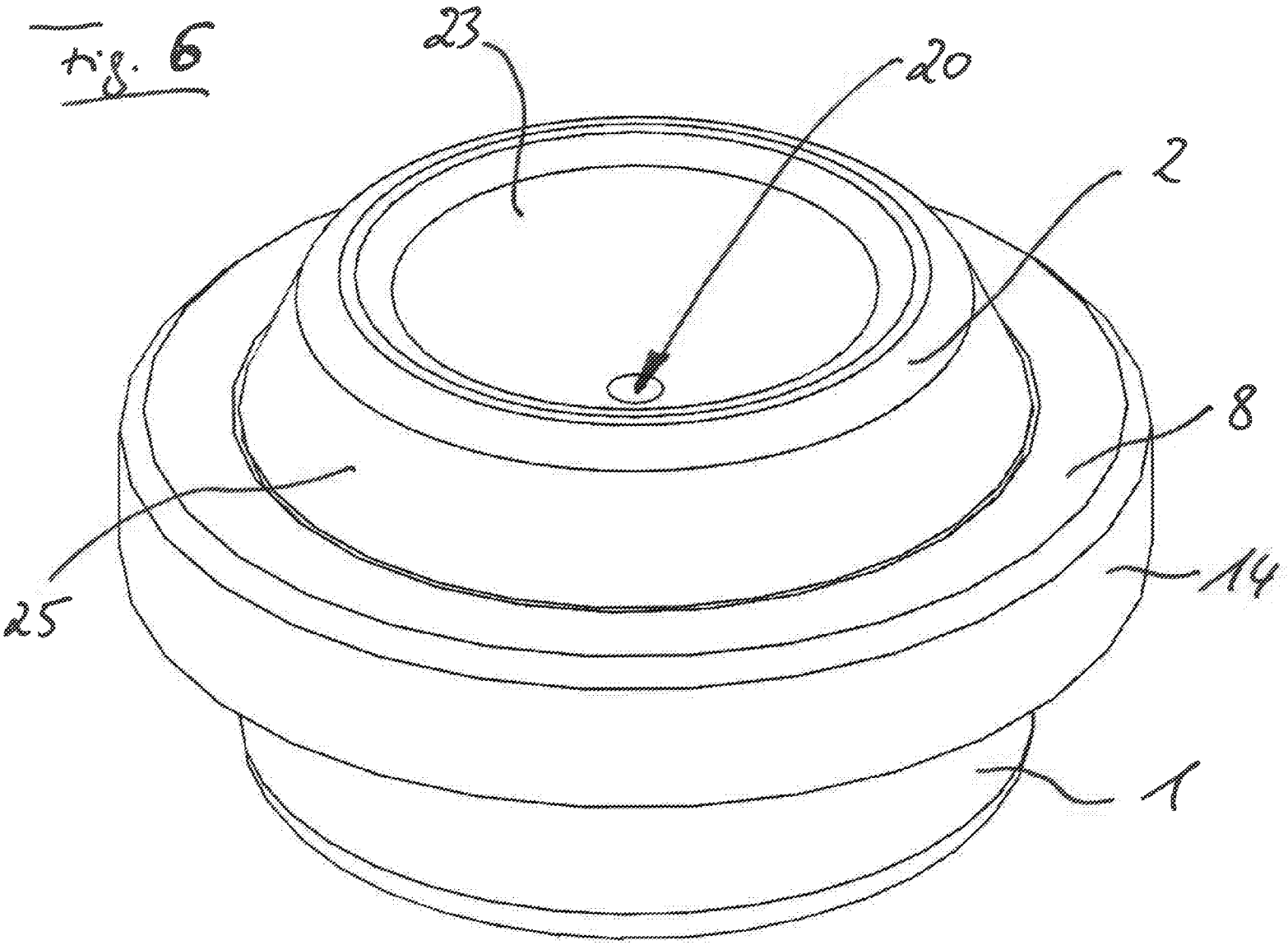

FIG. 6 shows the diaphragm with base body 1 and additional body 2 in a perspective representation, as corresponds to FIG. 4 in terms of the direction; FIG. 5 is the longitudinal section of FIG. 6. In order to achieve not only a radial positional change of the two parts of the diaphragm—base body 1 and additional body 2—but also an axial positional change along the longitudinal centre axis 7, there is a diaphragm holder (not represented). The diaphragm holder presses, from above in FIG. 6, on a part of the conical jacket 25 of the additional body 2 and butts against a diaphragm holder bearing surface 8 facing the electron source (see also FIGS. 2 and 5) of the flange 14 of the base body 1. It thus prevents an axial movement of the two parts base body 1 and additional body 2 relative to each other.

Figure 7:
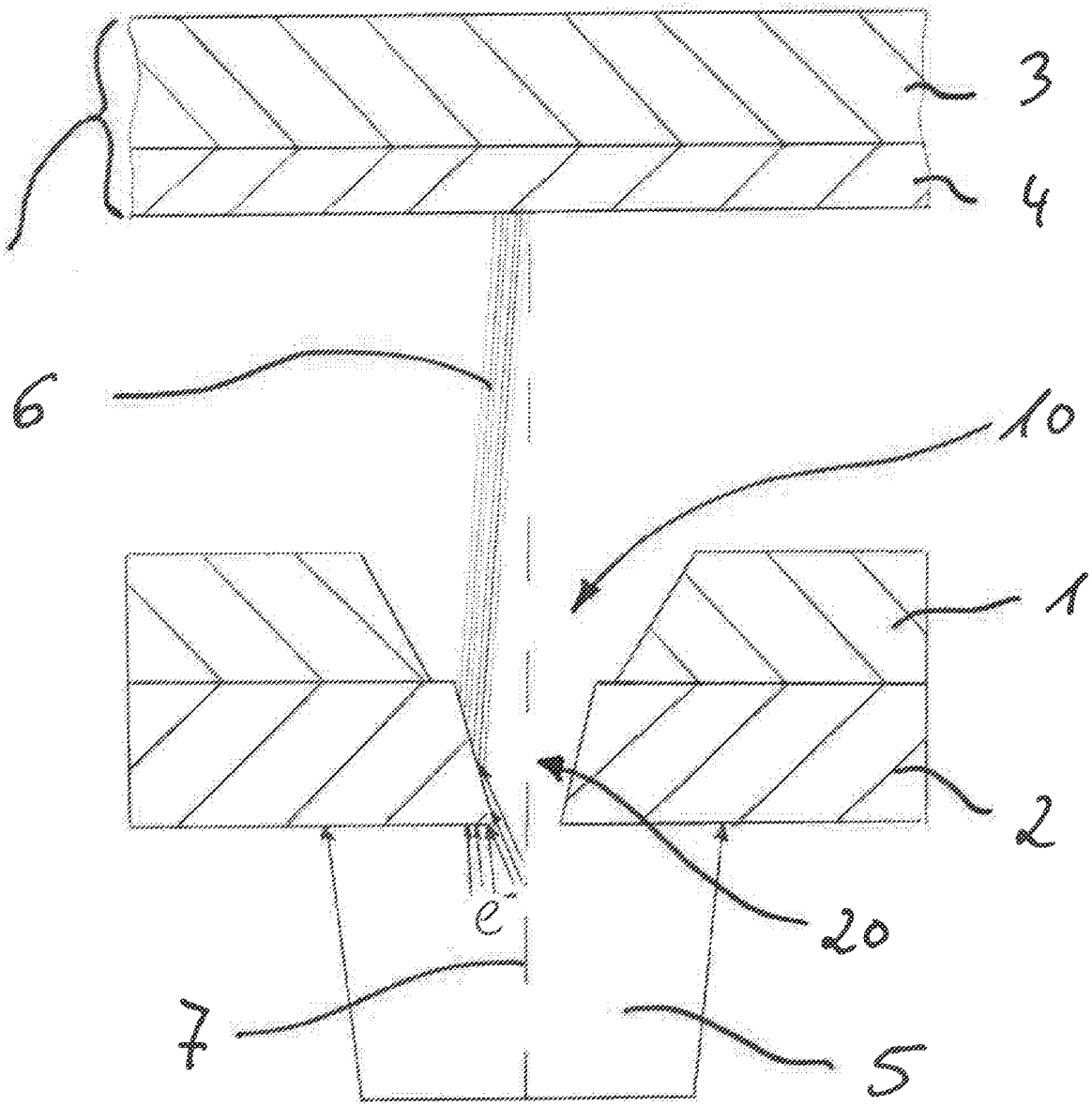

FIG. 7 shows a schematic representation of a part of an X-ray tube in the region of the target 9 in section. The target 9 is a target 9 known from the state of the art with a support material 3 and, applied thereto, target material 4 which the electron beam 5, which comes from an electron source (not shown), strikes and there produces X-radiation 6, The represented. X-ray tube is a transmission tube, without this limiting the invention.

The diaphragm serves to restrict the size of the focus of the X-ray tube, which means that the focus is only as large as electrons come through the first and second diaphragm apertures 10, 20.

In order to prevent the electrons of the electron beam 5 which strike the diaphragm from generating interfering X-radiation 6, the additional body 2 must be made of a material such that as little as possible and preferably much softer X-radiation than that which is produced at the target material 4 forms. For this purpose—in contrast to the state of the art, where the diaphragm material is a metal (in the case of the invention this only applies to the base body 1 of the diaphragm)—the additional body 2 is manufactured from graphite. As graphite has a low atomic number, the proportion of short-wave X-radiation is reduced, with the result that only a very small portion of stray radiation penetrates the target 9 and can cause image errors.

In order that electrons of the electron beam 5, which do not fly parallel to the longitudinal centre axis 7, do not also strike the metallic material of the base body 1—in the embodiment example it consists of molybdenum (with a high atomic number) and produce stray radiation, the first diaphragm aperture 10 has a cone shape widening towards the target 9. The base body 1 also has the function of shielding against the stray radiation being formed in the interior of the X-ray tube. For this a high atomic number and density is advantageous.

The aperture angle of the cone of the second diaphragm aperture 20 is chosen to be small in order to prevent astigmatic effects.

While the foregoing is directed to embodiments of the present invention, other and further embodiments and advantages of the invention can be envisioned by those of ordinary skill in the art based on this description without departing from the basic scope of the invention, which is to be determined by the claims that follow.

LIST OF REFERENCE NUMBERS

1 base body
2 additional body
3 support material
4 target material
5 electron beam
6 X-radiation
7 longitudinal centre axis
8 diaphragm holder bearing surface
9 target
10 first diaphragm aperture
11 first diaphragm entrance aperture
12 first diaphragm exit aperture

13 recess
14 flange
15 first bearing surface
20 second diaphragm aperture
21 second diaphragm entrance aperture
22 second diaphragm exit aperture
23 surface near the electron source
24 second bearing surface
25 conical jacket

What is claimed is:

1. A diaphragm for restricting a cross section of an electron beam emitted from an electron source of an X-ray tube comprising:

a base body made of a first material and which has a first cylindrical or conical-shaped diaphragm aperture;

a second body made of a second material and which has a second cylindrical or conical-shaped diaphragm aperture, the second body being arranged on a proximal side of the diaphragm with respect to the electron source, and wherein an atomic number of the first material is greater than an atomic number of the second material;

wherein the first and second diaphragm apertures each have a proximal end and a distal end with respect to the electron source, the distal ends having diameters that are not smaller than corresponding diameters at the proximal ends of the diaphragm apertures, the proximal end diameter of the second diaphragm aperture of the second body being less than a cross-sectional area of electron beam emitted from the electron source; and wherein the distal end of the second diaphragm aperture of the second body is axially aligned with and positioned adjacent to the proximal end of the first diaphragm aperture of the base body, and the distal end diameter of the second diaphragm aperture of the second body is less than the proximal end diameter of the first diaphragm aperture of the base hods.

2. A diaphragm according to claim 1, wherein the first diaphragm aperture and the second diaphragm aperture are arranged concentrically relative to each other.

3. A diaphragm according to claim 1, wherein the first diaphragm aperture and the second diaphragm aperture are in each case conical; and the diameter at the proximal end of the first diaphragm aperture is greater than the diameter at the distal end of the second diaphragm aperture.

4. A diaphragm according to claim 1, wherein a distal surface of the second body with respect to the electron source, and a proximal surface of the base body with respect to the electron source are in contact with each other over their entire surfaces.

5. A diaphragm according to claim 1, wherein the first material is a metal including at least one of molybdenum, tungsten and titanium, and the second material includes at least one of aluminium, beryllium, silicon, carbon, graphite, and boron.

6. A diaphragm according to claim 1, wherein the difference between the atomic numbers of first material and second material is at least sixteen.

7. A diaphragm according to claim 1, wherein a proximal surface of the base body with respect to the electron source has a recess with a first bearing surface, which is configured to receive a distal surface of a second bearing surface of the second body.

8. A diaphragm according to claim 1, wherein a proximal surface of the second body with respect to the electron source has a shape of a concave spherical surface segment.

9. An X-ray tube including means for directing an electron beam onto a target and a diaphragm according to claim 1, the target and diaphragm being arranged in a propagation path of the electron beam.

10. An X-ray tube according to claim 9, wherein a diaphragm holder surrounds both the second body and the base body of the diaphragm at their radial ends such that the body and the base body are pressed against each other.

11. A diaphragm according to claim 1, wherein a difference between the atomic numbers of first material and second material is at least thirty six.

12. A diaphragm according to claim 1, wherein the X-ray tube is a micro-focus X-ray tube.

13. A diaphragm according to claim 1, wherein the second body is installed on a proximal side of the first body with respect to the electron source.

14. A diaphragm according to claim 1, wherein the diaphragm is positioned between the electron source to direct the electron beam onto a target positioned below the diaphragm.

* * * * *